US012061060B1

(12) United States Patent
Liu

(10) Patent No.: US 12,061,060 B1
(45) Date of Patent: Aug. 13, 2024

(54) ARROW SHOOTING DEVICE WITH ARROW CHAIN DRIVING STRUCTURE

(71) Applicant: Chi-Chang Liu, Taichung (TW)

(72) Inventor: Chi-Chang Liu, Taichung (TW)

(73) Assignee: POE LANG ENTERPRISE CO., LTD.

( * ) Notice: Subject to any disclaimer, the term of this patent is extended or adjusted under 35 U.S.C. 154(b) by 0 days.

(21) Appl. No.: 18/204,954

(22) Filed: Jun. 2, 2023

(51) Int. Cl.
*F41A 9/29* (2006.01)
*F41A 9/32* (2006.01)
*F41B 5/12* (2006.01)

(52) U.S. Cl.
CPC ..... *F41A 9/32* (2013.01); *F41A 9/29* (2013.01); *F41B 5/126* (2013.01)

(58) Field of Classification Search
CPC ..... F41B 5/126; F41A 9/29; F41A 9/32
See application file for complete search history.

(56) References Cited

U.S. PATENT DOCUMENTS 2,417,080 A * 3/1947 Lochhead ..... F41A 9/32 89/33.2
2,453,977 A * 11/1948 Eames ..... F41A 9/32 74/130
2022/0107151 A1* 4/2022 Bennink ..... F41A 3/66
2022/0205749 A1* 6/2022 Franssen et al. ..... F41A 9/32

* cited by examiner

*Primary Examiner* — John E Simms, Jr.

(57) ABSTRACT

An arrow shooting device with an arrow chain driving structure is disclosed. The arrow shooting device includes a gun body having a gun chamber and a chain hole, an arrow chain is inserted into a side of the chain hole and exposed out of the other side of the chain hole, the chain driving assembly is disposed in the gun chamber and controlled by the driving assembly to move, the moving chain driving assembly drives the arrow chain to move between two end openings of the chain hole, the chain driving assembly includes a first slider and a second slider. The second slider has a driving block to engage the arrow chain, the driving assembly is operated to repeatedly drive the first slider and the second slider to control the driving block to push the arrow chain to move through the chain hole.

10 Claims, 15 Drawing Sheets

ARROW SHOOTING DEVICE WITH ARROW CHAIN DRIVING STRUCTURE

BACKGROUND OF THE INVENTION

1. Field of the Invention

The present invention is related to an arrow shooting device with an arrow chain driving structure, and particularly to the technology applied in the field of arrow shooting; the arrow shooting device is able to drive an arrow chain loaded with multiple arrows, to provide a user to continuously shoot.

2. Description of the Related Art

In the early shooting sports, bullet shooting devices have continuous shooting structures; however, in the arrow shooting sport, a shooter must draw and mount arrows one by one before shooting, and the shooter's mental state is easily distracted and interrupted during these archery processes, and it affects the accuracy and stability of shooting. Therefore, a continuous shooting structure is developed for bullet shooting sport of bullets. For example, Taiwan new model Pat. No. M627524 discloses a bullet chain in a simulated bouncing chain structure of a toy gun.

A conventional arrow shooting device does not have a structure like the above-mentioned bullet chain. Some manufactures developed new type of arrow boxes, for example, Taiwan invention Pat. No. 1738463 discloses a crossbow arrow loading device enabling a user to perform continuous shooting operations. However, compared with the bullet chain, the conventional arrow box has several shortcomings, first, the number of shots is limited by a height of the arrow box, the number of arrows that the arrow box can hold is limited, and the arrow box loaded too many arrows also increases the user's burden on operation; secondly, the arrow loading operation of the arrow box is too time-consuming. For example, for some arrow boxes, the arrow box must be removed from the bow first for loading arrows into the arrow box one by one, the arrow box loaded with multiple arrows is then mounted on the bow; after shooting the limited number of arrows, it is necessary for a user to repeat the above-mentioned operation to load arrows again, the above-mentioned process undoubtedly affects the concentration and stability of the user in shooting. Obviously, the use of the above-mentioned arrow box still has certain deficiencies for the user.

SUMMARY OF THE INVENTION

An objective of the present invention is to provide a continuous arrow shooting operation to shoot more arrows without being limited by a height of an arrow box, and the continuous shooting operation is more simple and easy to use. Another objective of the present invention is to improve the conventional problem that the number of arrows is limited to the height of the arrow box in the continuous arrow shooting operation, and an excessively high arrow box increases the weight of the whole group of bows and arrows, and loading arrows into the arrow box takes time in repeated disassembling and assembling operations, and it affects the concentration and stability of shooting.

In order to achieve the objective and effect, the present invention discloses an arrow shooting device with an arrow chain driving structure. The arrow shooting device includes a gun body, a chain hole, a driving assembly, and a chain driving assembly. The gun body includes a gun chamber disposed therein. The chain hole is cut through a side of the gun body to other side of the gun body, wherein an arrow chain is inserted into a side of the chain hole and exposed out of other side of the chain hole. A part of the driving assembly is disposed in the gun chamber and movable in the gun chamber. The chain driving assembly is disposed in the gun chamber, wherein the part of the driving assembly disposed in the gun chamber is configured to move, push and release the chain driving assembly, the chain driving assembly includes a first slider and a second slider, the first slider and the second slider are slidably disposed in the gun chamber, a longitudinal line and a horizontal line are defined for a space in the gun chamber, the first slider is movable along a direction of the longitudinal line, the second slider is movable along a direction of the horizontal line, the first slider has at least one oblique groove recessed on a bottom thereof, and the second slider has an oblique guiding block protruded on a top thereof and inserted into the at least one oblique groove. The second slider has a driving block mounted on an end thereof near the chain hole, and the driving block is engaged with the arrow chain after the arrow chain is inserted into the chain hole. After the arrow chain is inserted into the side of the chain hole, the arrow chain is engaged with the driving block, the part of the driving assembly pushes the first slider to move along the direction of the longitudinal line, the second slider is driven to move along a direction of the horizontal line by the first slider through connection between the at least one oblique groove and the oblique guiding block, the moving second slider controls the driving block to push the arrow chain to exposed out of the other side of the chain hole.

According to the above description, the advantage of the present invention is that the arrow chain is able to mount more arrow bodies, and after the arrow chain is mounted in the chain hole of the gun body, the chain driving assembly is operated to drive the arrow chain to continuously move from the side of the chain hole to the other side of the chain hole, to maintain stability and continuity in shooting, eliminate the need to repeatedly set up the arrow bodies, or load the arrow bodies into the arrow box one by one, thereby shortening the shooting time between arrow bodies. Therefore, the user can continue to maintain a high degree of concentration and maintain the accuracy of shooting. In addition, the configuration with the arrow chain of the present invention provides the user with the ability to shoot a large number of arrow bodies in a short time, to solve the conventional problem that a limited number of arrow bodies that can only be loaded due to the height of the conventional arrow box.

BRIEF DESCRIPTION OF THE DRAWINGS

The structure, operating principle and effects of the present invention will be described in detail by way of various embodiments which are illustrated in the accompanying drawings.

DETAILED DESCRIPTION OF THE PREFERRED EMBODIMENTS

Figure 1:
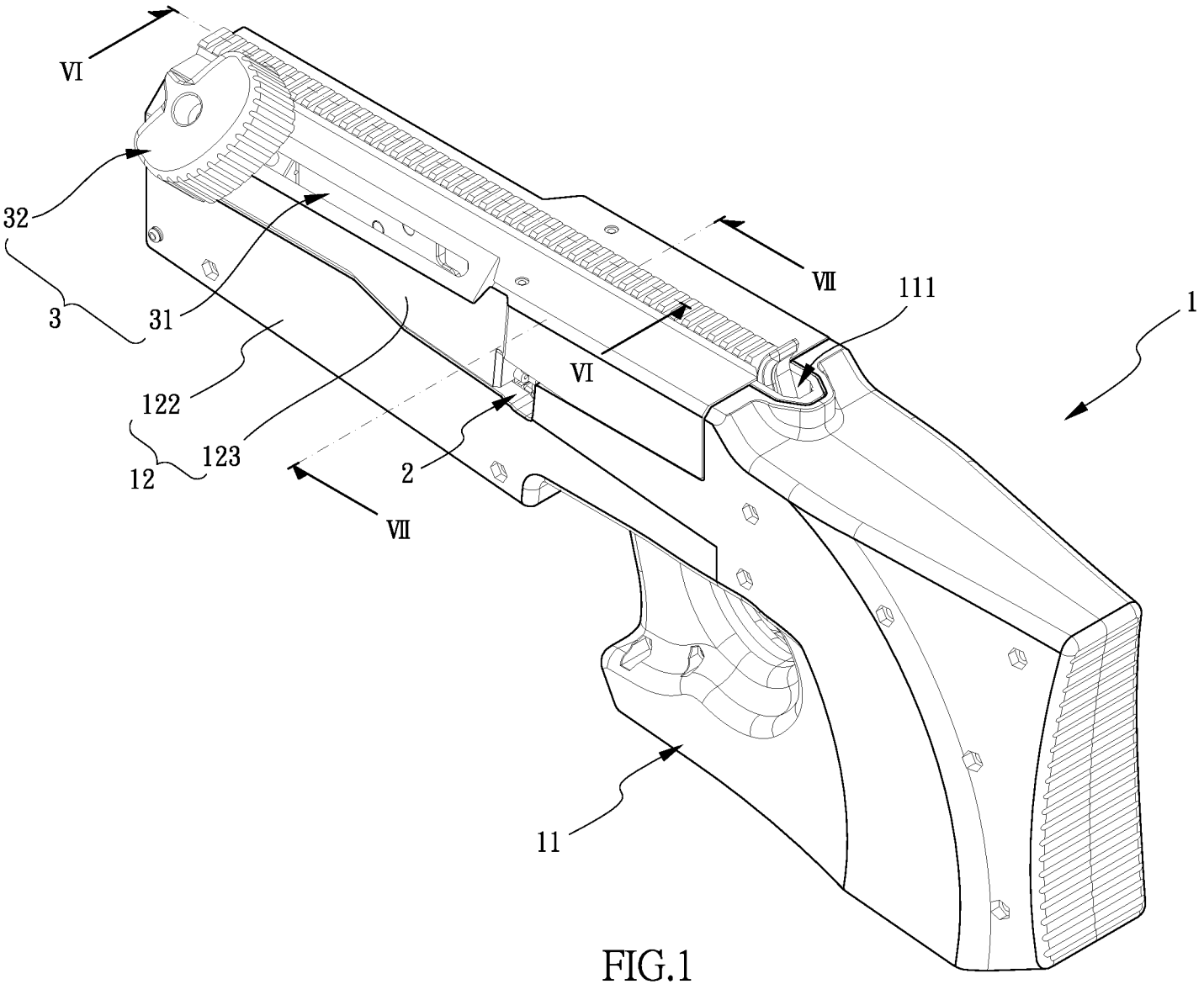
FIG. 1 is a perspective view of a gun body and a gun cover that are assembled with each other, according to the present invention.

The following embodiments of the present invention are herein described in detail with reference to the accompanying drawings. These drawings show specific examples of the embodiments of the present invention. These embodiments are provided so that this disclosure will be thorough and complete, and will fully convey the scope of the invention to those skilled in the art. It is to be acknowledged that these embodiments are exemplary implementations and are not to be construed as limiting the scope of the present invention in any way. Further modifications to the disclosed embodiments, as well as other embodiments, are also included within the scope of the appended claims.

These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts. As used herein, the singular forms "a", "an" and "the" are intended to include the plural forms as well, unless the context clearly indicates otherwise.

It is to be acknowledged that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

It will be acknowledged that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present.

In addition, unless explicitly described to the contrary, the words "comprise" and "include", and variations such as "comprises", "comprising", "includes", or "including", will be acknowledged to imply the inclusion of stated elements but not the exclusion of any other elements.

Please refer to FIG. 1 to FIG. 14. An arrow shooting device of the present invention includes a gun body 1, a chain hole 2, a driving assembly 3, and a chain driving assembly 4. The gun body 1 includes a rear support part 11 and a front driving part 12, the front driving part 12 has a gun chamber 121 formed therein, and the rear support part 11 is connected to the front driving part 12. The chain hole 2 is cut through the front driving part 12 from a side of the gun body 1 to other side of the gun body 1. An arrow chain 10 is inserted into a side of the chain hole 2 and exposed out of other side of the chain hole 2, and the arrow chain 10 is mounted with arrow bodies 20.

The driving assembly 3 includes an internal assembly 31 and an external assembly 32, the internal assembly 31 is disposed in the gun chamber 121, and the external assembly 32 is disposed outside the gun body 1 to connect to the internal assembly 31. The external assembly 32 is longitudinally slidable relative to the gun body 1, to drive the internal assembly 31 to move. The chain driving assembly 4 is mounted in the gun chamber 121 and near the rear support part 11, and the moving internal assembly 31 pushes the chain driving assembly 4 to move. The chain driving assembly 4 further includes a base 41, a first slider 42, and a second slider 43, the base 41 has an accommodation space 411 recessed on a top thereof, the first slider 42 and the second slider 43 are slidably disposed in the accommodation space 411, a longitudinal line A and a horizontal line B are defined for the accommodation space 411, the first slider 42 is pushed by the internal assembly 31 to move along a direction of the longitudinal line A, and the second slider 43 is movable along a direction of the horizontal line B. The first slider 42 has at least one oblique groove 421 recessed a bottom thereof, and the second slider 43 has an oblique guiding block 431 protruded on a top thereof and configured to insert into the at least one oblique groove 421. When the first slider 42 is moved longitudinally along the longitudinal line A, the second slider 43 is controlled to move along the horizontal line B. The base 41 is inserted through a driving hole 412 to connect the accommodation space 411 and the chain hole 2, the second slider 43 has a driving block 5 mounted on an end thereof corresponding to the driving hole 412, and the driving block 5 is disposed in the driving hole 412 and engaged with the arrow chain 10.

Figure 13:
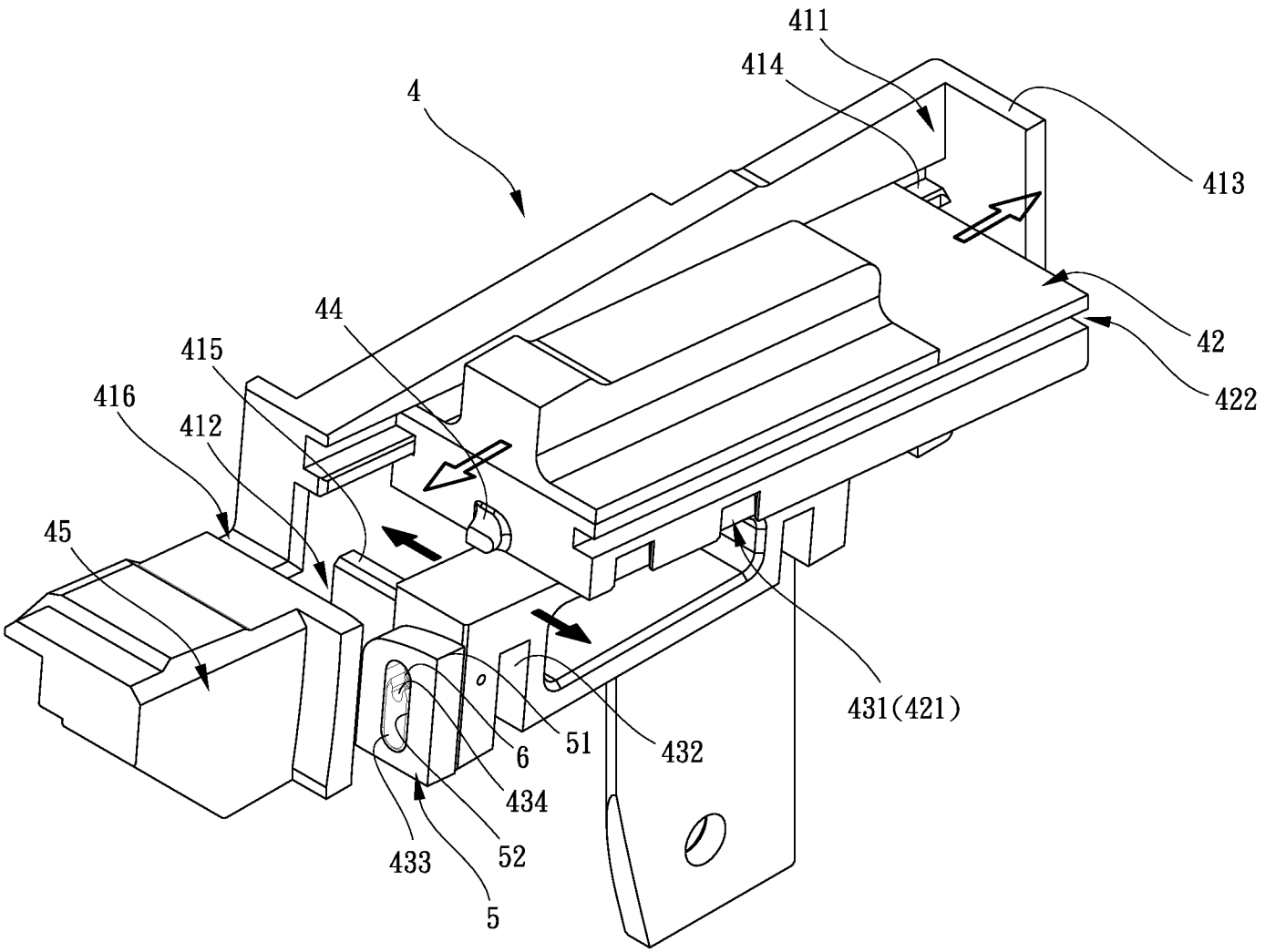
FIG. 13 is a schematic view of movements of a first slider and a second slider of a chain driving assembly, according to the present invention.
Figure 14:
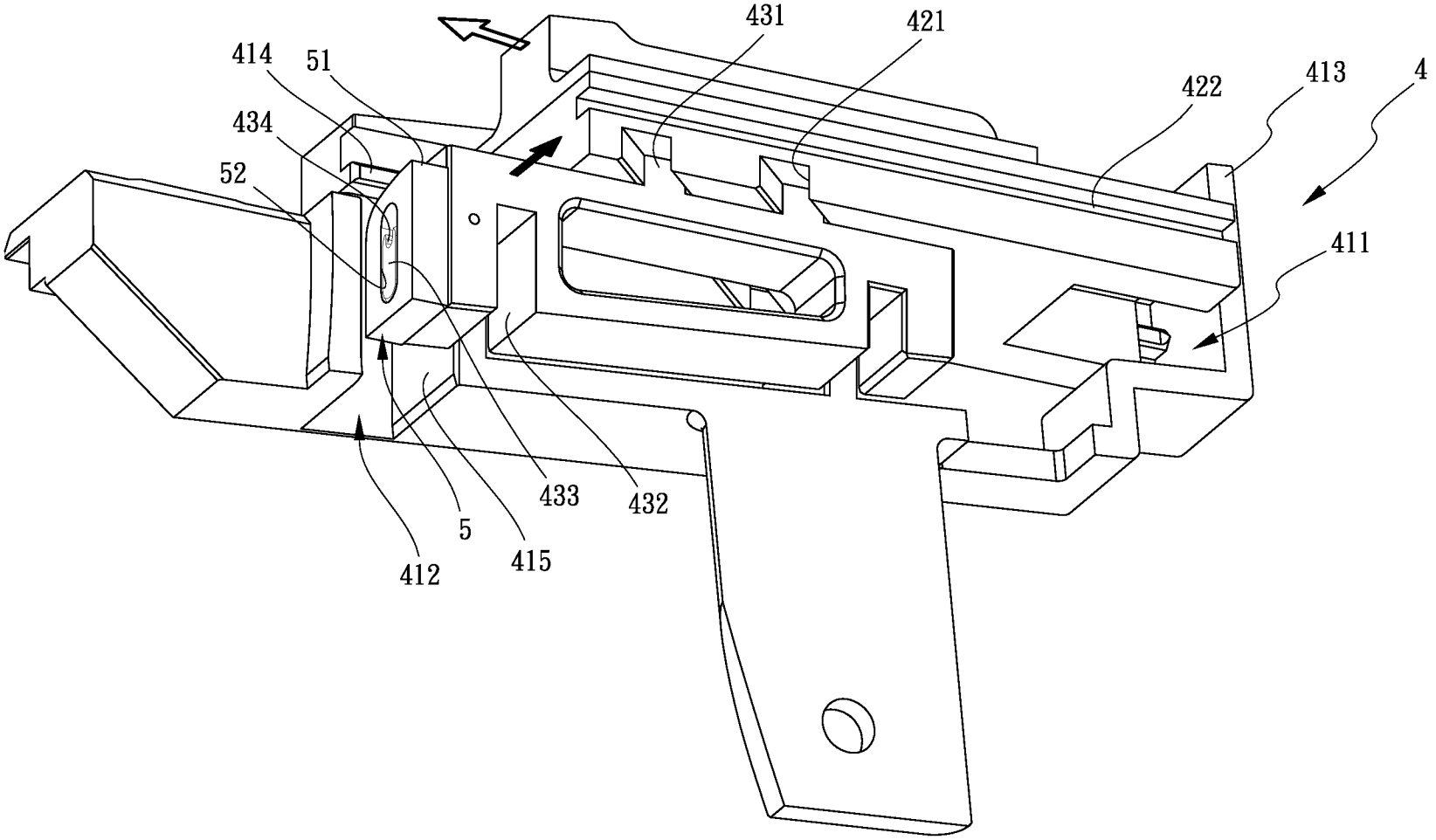
FIG. 14 is a schematic view of the operation of FIG. 13, when viewed from another angle.

Please refer FIG. 13 and FIG. 14. When a user wants to shoot a large number of arrow bodies 20, the user needs to insert the arrow chain 10 mounted with the arrow body 20 from the side of the chain hole 2, to make the chain driving assembly 4 engage with the driving block 5 first, and after the external assembly 32 drives the internal assembly 31 to move toward the chain driving assembly 4, the internal assembly 31 pushes the first slider 42 to move along the direction of the longitudinal line A, the connection between the at least one oblique groove 421 and the oblique guiding block 431 makes the first slider 42 longitudinally move along the direction of the longitudinal line A (such as hollow arrowheads shown in FIG. 13 and FIG. 14), and make the second slider 43 move left and right along the direction of the horizontal line B (such as solid arrowheads shown in FIG. 13 and FIG. 14). The moving second slider 43 controls the driving block to push the arrow chain 10 to move out of the other side of the chain hole 2.

Figure 10:
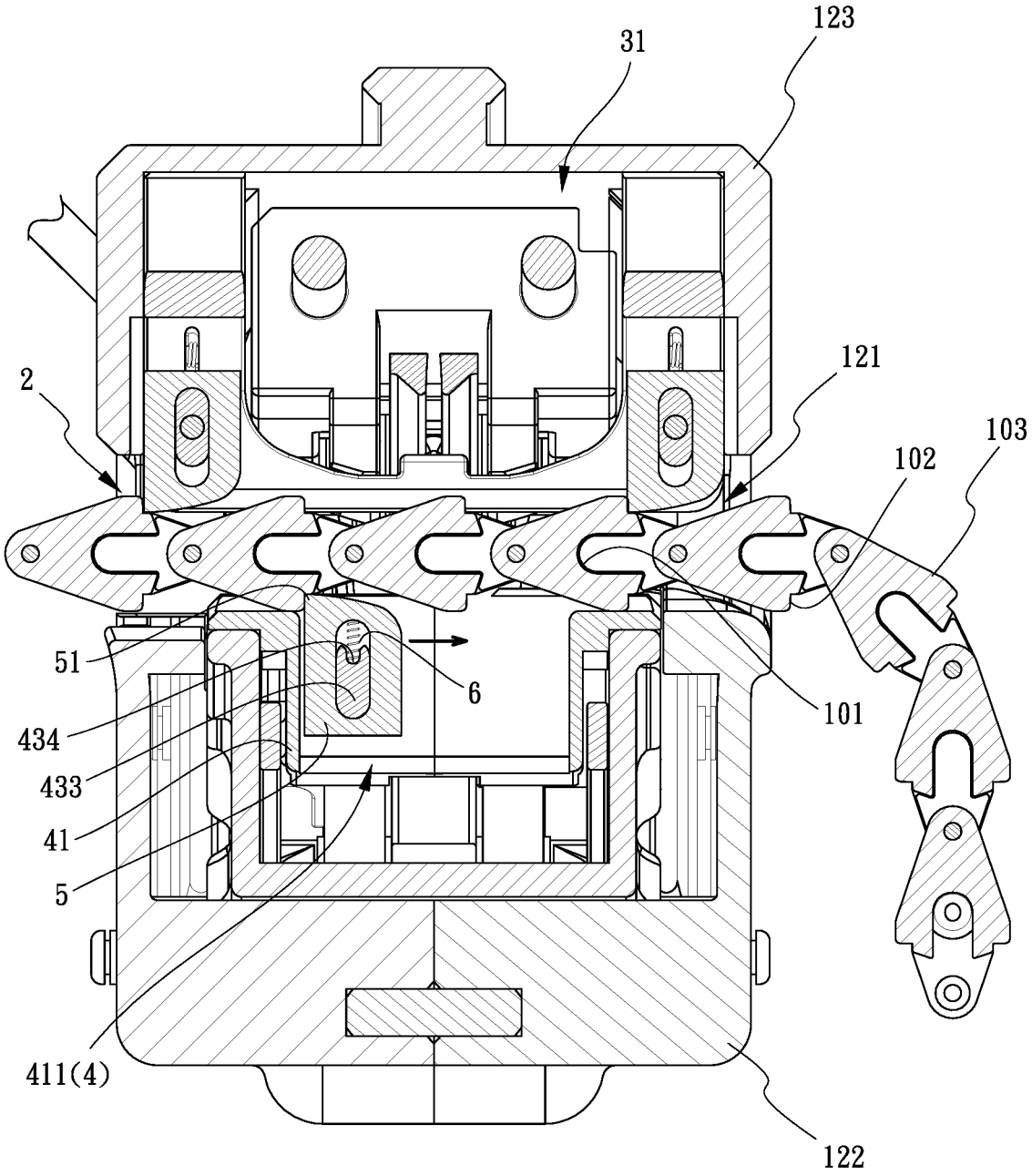
FIG. 10 to FIG. 12 are schematic view showing continuous operations that a driving block pushes an arrow chain to move after the chain driving assembly of FIG. 7 is moved.
Figure 11:
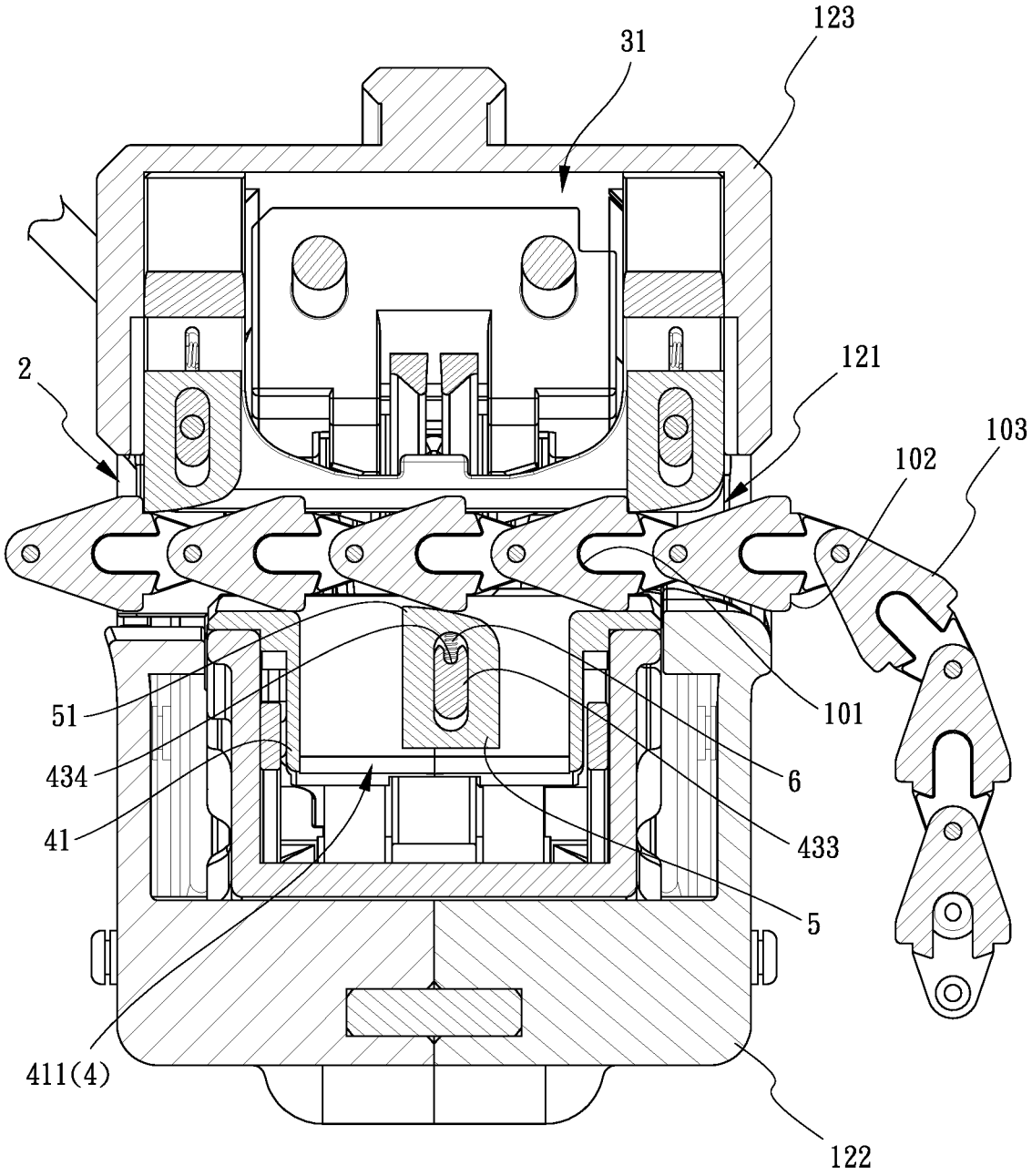
Figure 12:
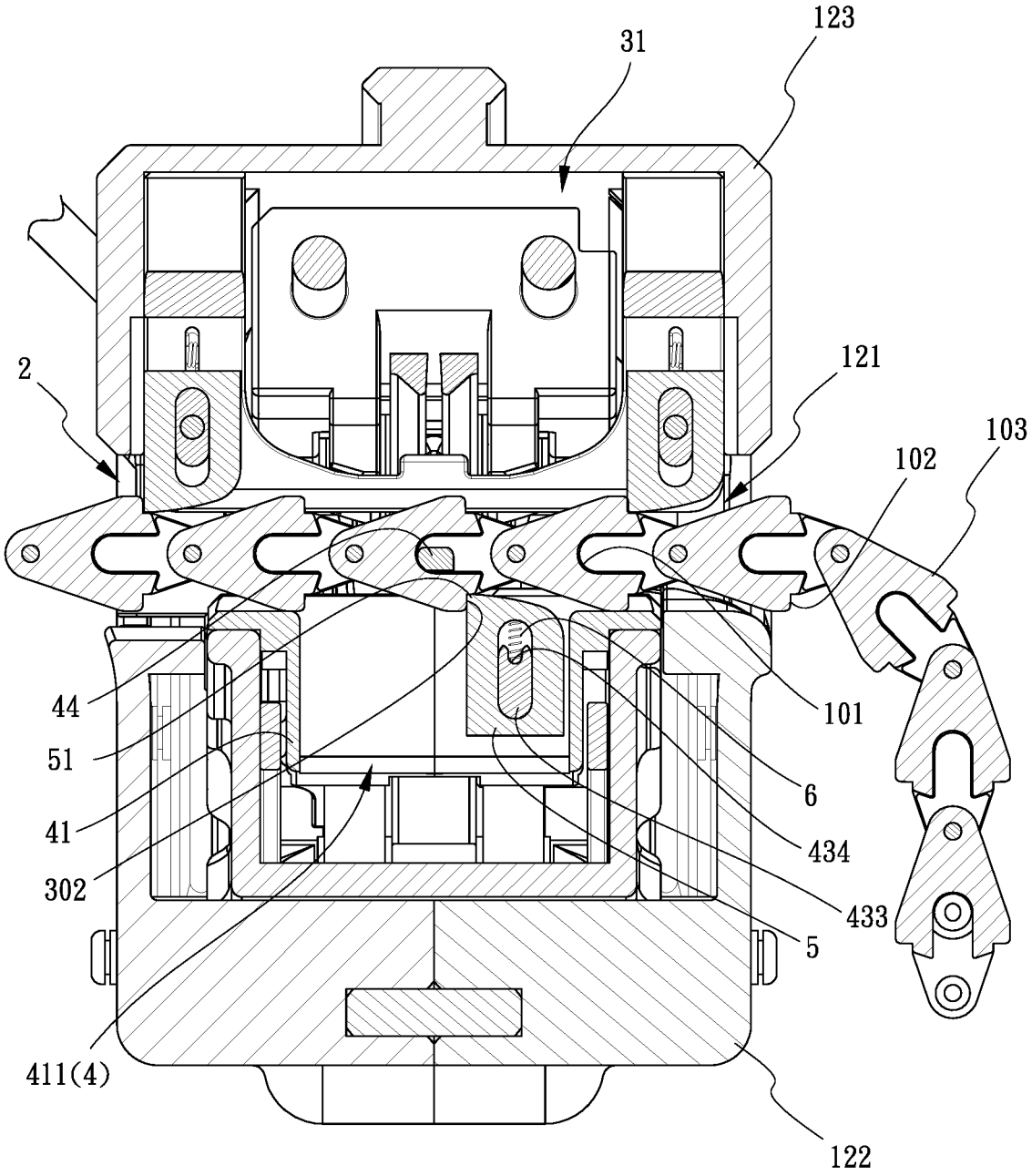

According to the above-mentioned content, in conventional technology, the arrows must be mounted on bow one by one, so the accuracy and stability of shooting are affected easily and the number of arrows is limited by the height of the arrow box, and the user can only shoot a limited number of arrows in the shooting operation; furthermore, a user must first remove the conventional arrow box from a bow for loading arrow bodies, and then mount the arrow box with arrow bodies on the bow, so the above-mentioned operation is too complex and time-consuming for the user. Therefore, when the arrow shooting device of the present invention is applied with the arrow chain 10, the arrow chain 10 is inserted into the side of the chain hole 2, the base 41 has a chain support groove 416 laterally cut through an end thereof near the chain hole 2, the driving hole 412 cut through the bottom of the chain support groove 416, the driving block 5 is located in the driving hole 412 and movable along the direction of the horizontal line B, an end of the driving block 5 that is engaged with the arrow chain 10 is protruded out of the driving hole 412; after the arrow chain 10 is inserted into the chain hole 2, the arrow chain 10 is mounted on the chain support groove 416 to movably assembled with the driving block 5, the chain driving assembly 4 is driven to push the chain driving assembly 4 to move, the first slider 42 is movable along the direction of the longitudinal line A, the second slider 43 is movable in the direction of the horizontal line B, and the moving chain driving assembly 4 makes the driving block 5 move left and right in the direction of the horizontal line B; in this case, the driving block 5 is released from the situation of being assembled with the arrow chain 10, and moved back to its original position and assembled with the arrow chain 10 again. As a result, the repeated left and right movement of the driving block 5 can be used to drive the arrow chain 10 to enter the side of the chain hole 2 and move out from the other side of the chain hole 2, in sequential order, as shown in FIG. 10 to FIG. 12.

Figure 4:
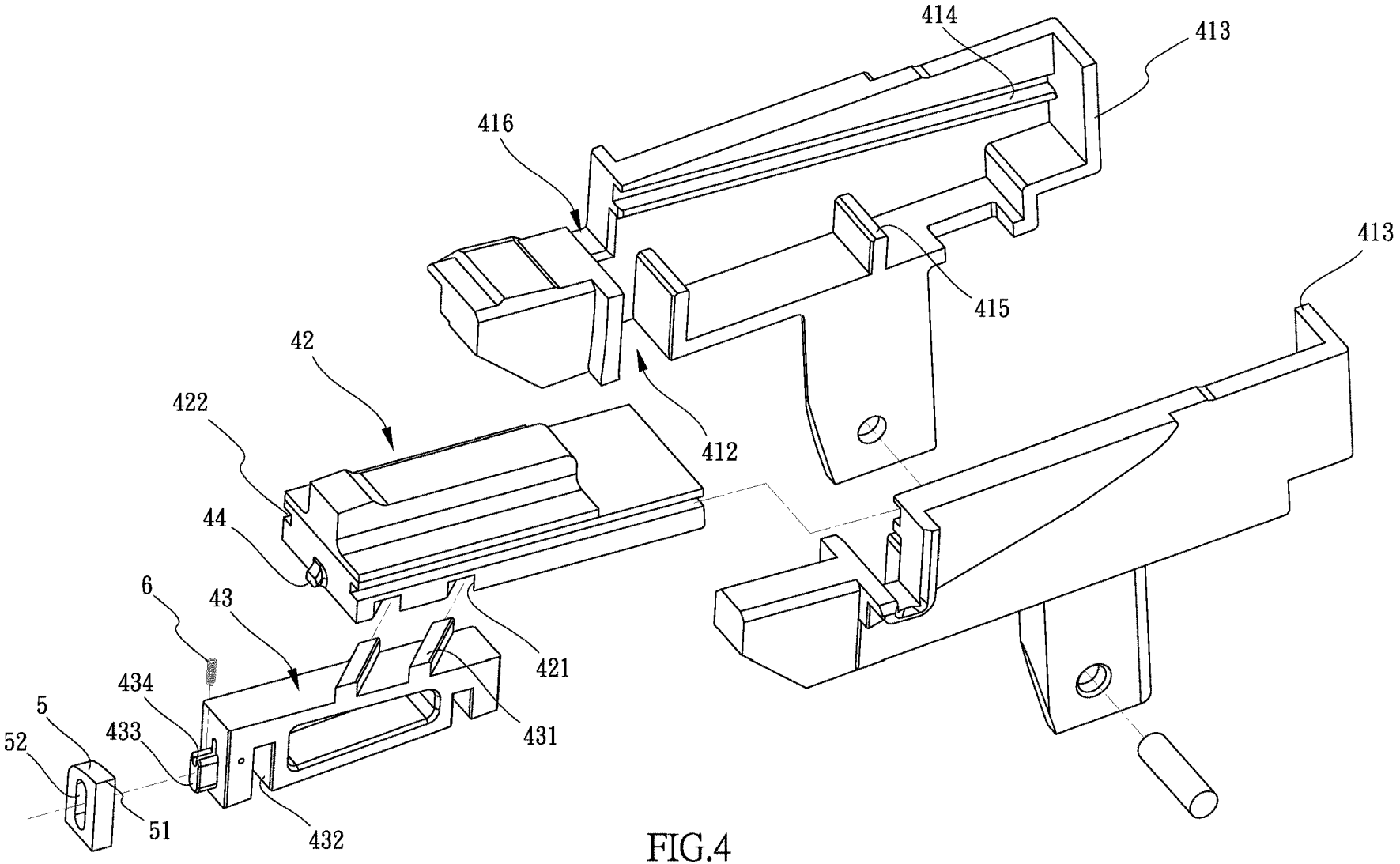
FIG. 4 is a perspective exploded view of a chain driving assembly of the present invention.

Other technical features of the present invention will be illustrated in the following paragraphs. The configuration of the base 41 is to make the first slider 42 smoothly slide, as shown in FIG. 4, FIG. 13 and FIG. 14, the base 41 includes two covers 413, the two covers 413 can be combined to form the accommodation space 411, and the accommodation space 411 has track blocks 414 protruded on two inner sidewalls thereof, respectively, the track blocks 414 are disposed in the direction of the longitudinal line A; the first slider 42 has track grooves 422 respectively recessed on two sides thereof and corresponding in position to the track blocks 414 for forming slidable connection, and each of the track blocks 414 can be inserted into a corresponding one of the track grooves 422. Through the slidable connections between the track grooves 422 and the track blocks 414, the first slider 42 can be smoothly moved and prevented from falling in the accommodation space 411.

Similar to the first slider 42, it is also necessary to enable the second slider 43 to smoothly move, as shown in FIG. 4, FIG. 13 and FIG. 14, the accommodation space 411 has at least one protrusion plate 415 extended from a bottom thereof toward an opening thereof, and an arrangement direction of the at least one protrusion plate 415 is in the direction of the horizontal line B; the second slider 43 has an insertion slot 432 formed on a bottom thereof, the at least one protrusion plate 415 is inserted in the insertion slot 432, the second slider 43 is movable in the arrangement direction of the at least one protrusion plate 415, to prevent the second slider 43 from freely sliding or falling in the accommodation space 411.

Figure 5:
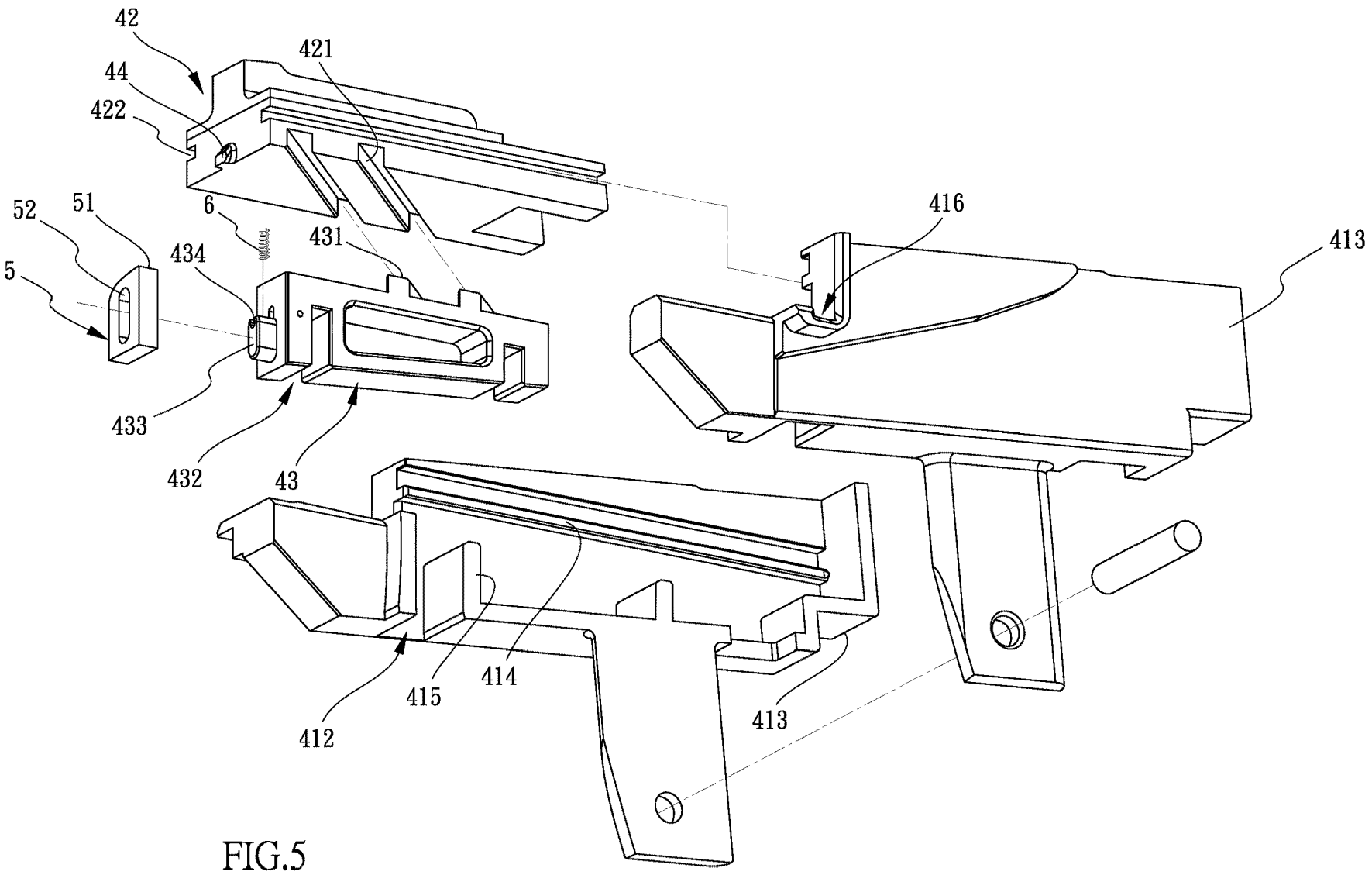
FIG. 5 is a perspective exploded view of FIG. 4, when viewed from another angle.
Figure 6:
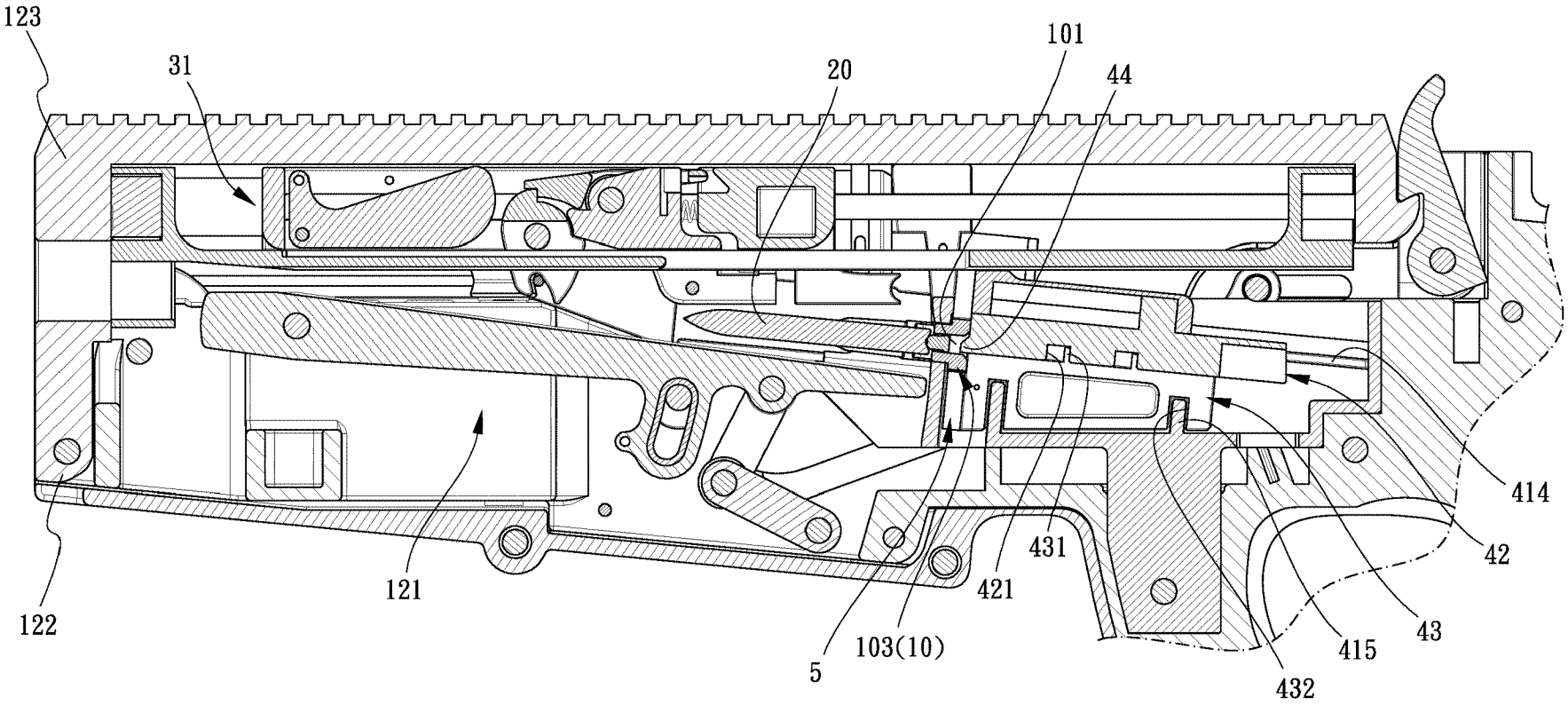
FIG. 6 is a schematic cross-sectional view taken along VI-VI of FIG. 1.
Figure 7:
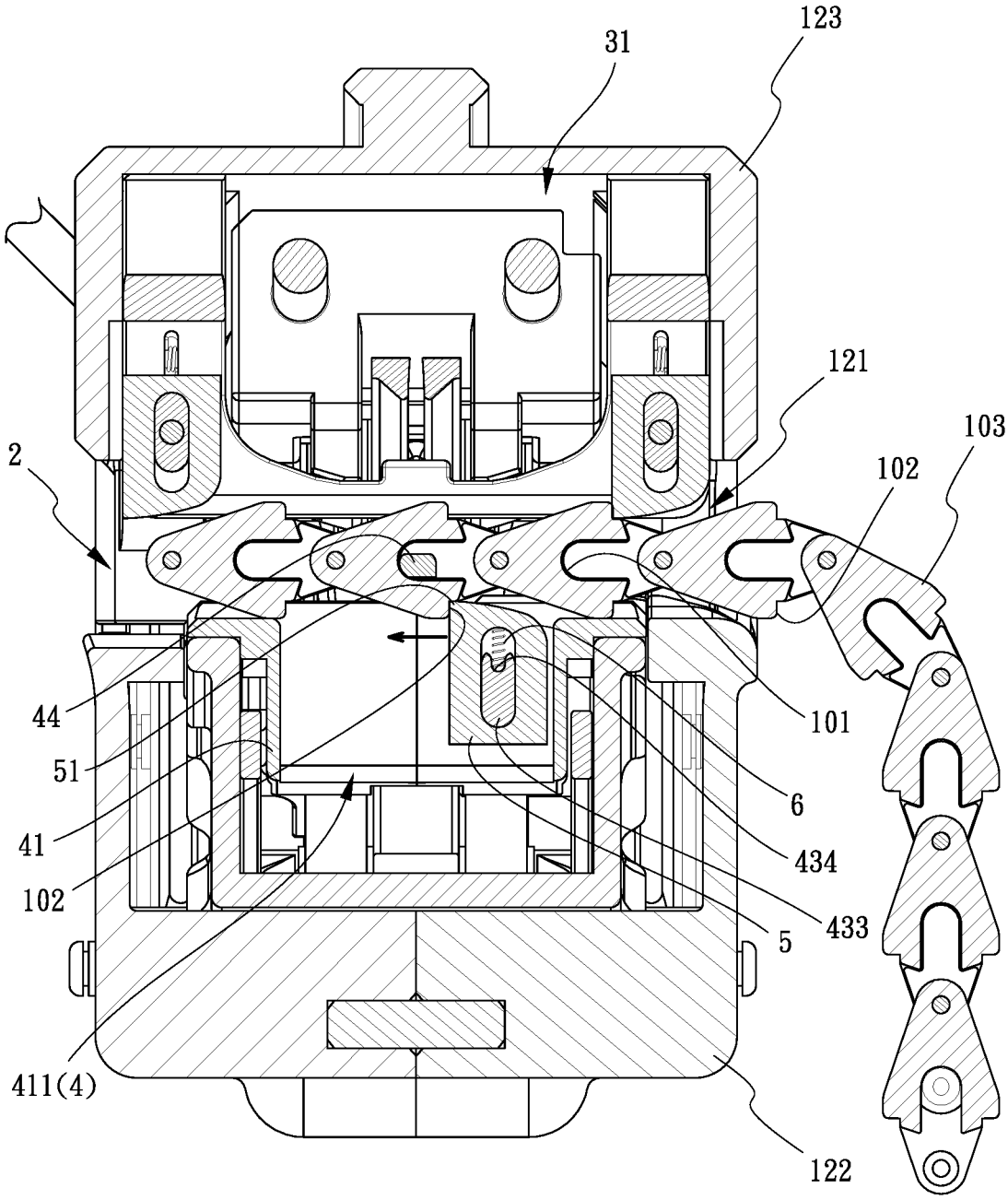
FIG. 7 is a schematic cross-sectional view taken along VI-VII of FIG. 1.
Figure 8:
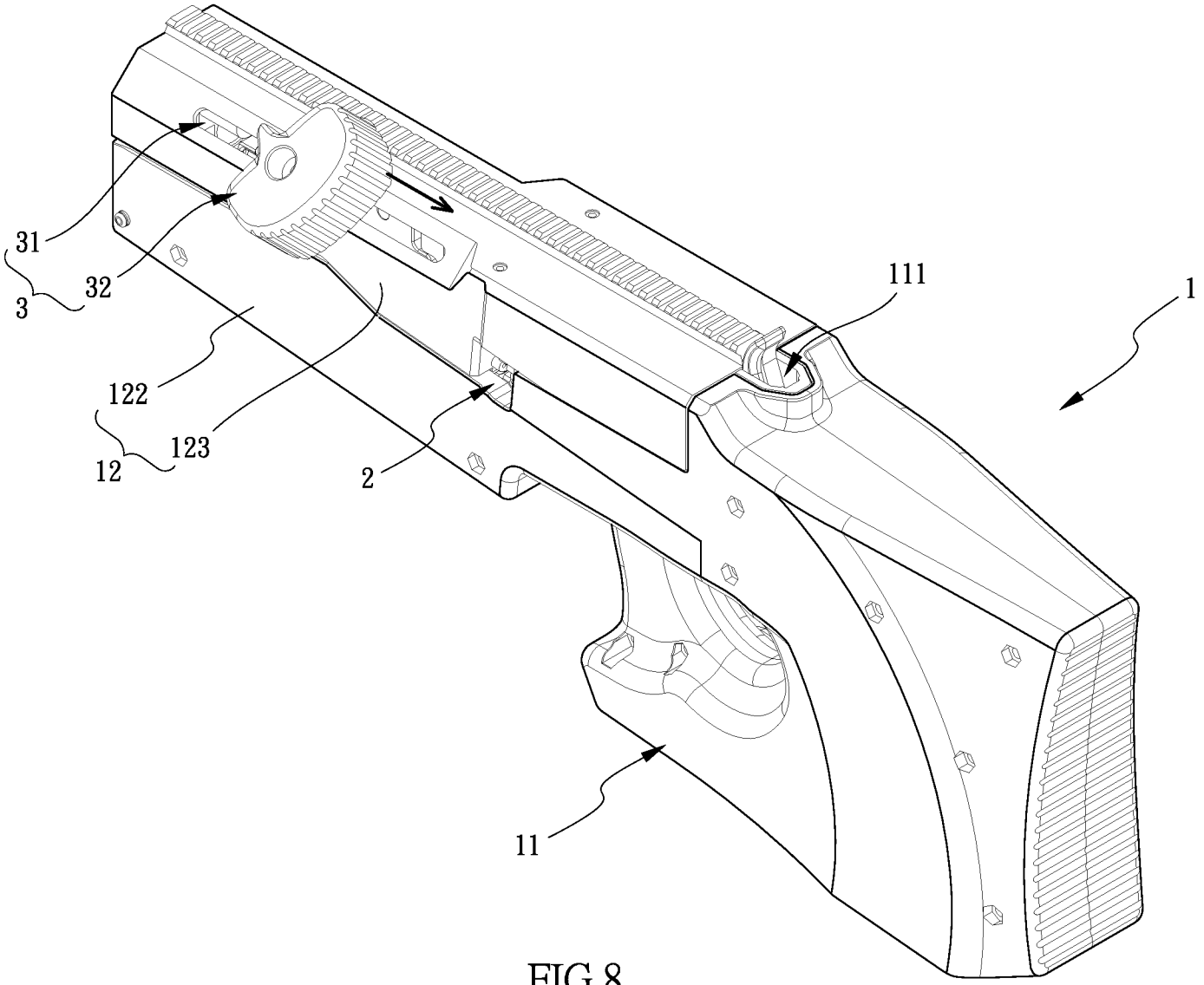
FIG. 8 is a schematic view of an operation of moving the external assembly of FIG. 1.
Figure 9:
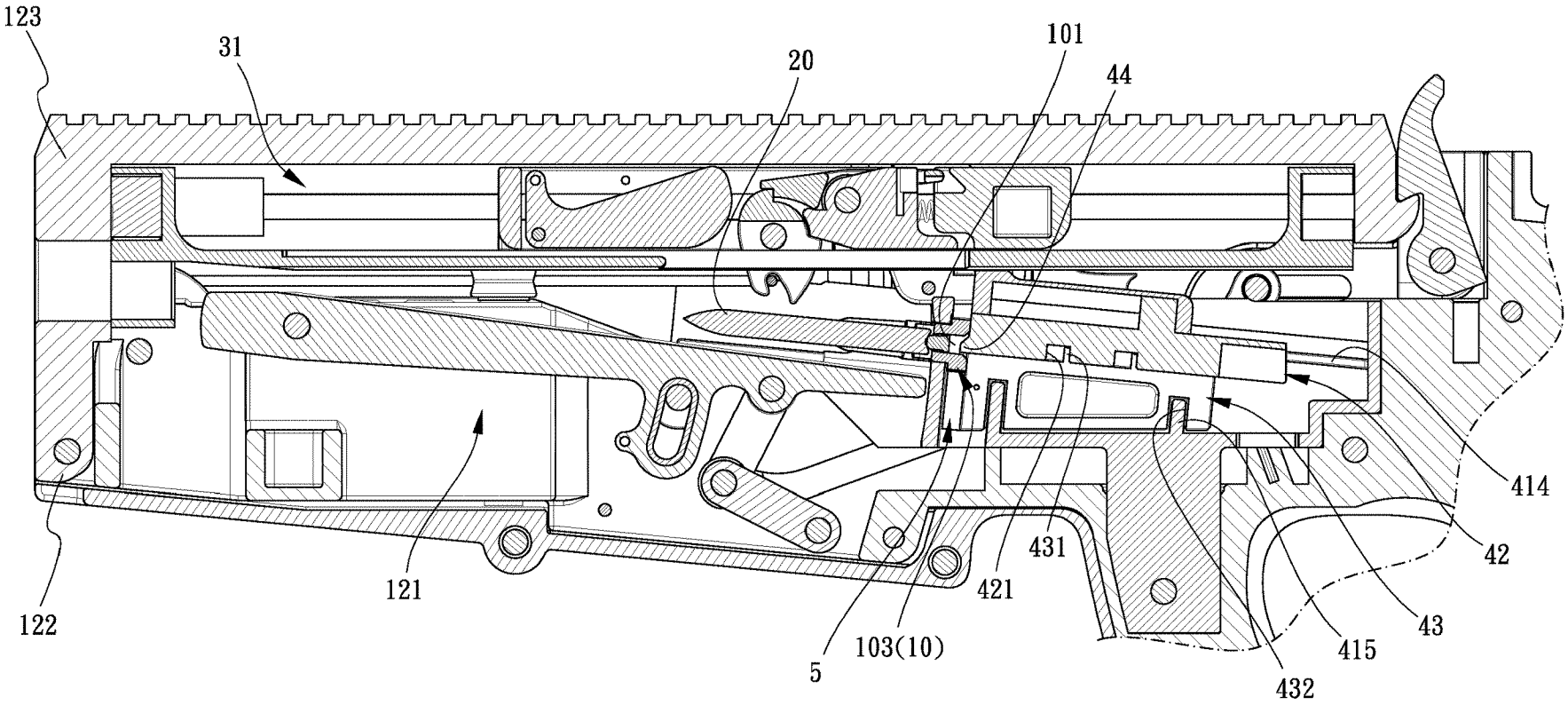
FIG. 9 is a schematic view showing an operation that the external assembly of FIG. 6 drives an internal assembly to move.

As shown in FIG. 5, the two oblique grooves 421 formed on the bottom of the first slider 42 are arranged in an oblique direction from down to up, and from right to left; as shown in FIG. 4, the oblique guiding blocks 431 of the second slider 43 are arranged in an oblique direction from down to up, and from left to right. That is, the movements of the first slider 42 and the second slider 43 are misaligned, so that the first slider 42 is movable in the direction of the longitudinal line A, and the second slider 43 is movable in the direction of the horizontal line B.

For the assembly between the chain driving assembly 4 and the arrow chain 10, in order to prevent the driving block 5 and the arrow chain 10 from not being engaged with each other as expected, the arrow chain 10 has fastening grooves 101 formed thereon, as shown in FIG. 10 to FIG. 12, and the first slider 42 has a stopper block 44 protruded on an end side thereof facing the arrow chain 10; after a user mounts the arrow chain 10 into the chain hole 2, an end of the driving block 5 is engaged with the arrow chain 10 and the stopper block 44 is inserted into one of the fastening grooves 101 on the arrow chain 10, the fastening groove 101 is within the same area range where the arrow chain 10 is engaged with the driving block 5, so that a limitation mechanism can be formed between the arrow chain 10 and the driving block 5, to ensure that the arrow chain 10 can be smoothly moved without chain jumping.

For the operation of driving the arrow chain 10 to move, the driving block 5 includes a sharp top 51, the arrow chain 10 has step-shaped grooves 102 formed thereon, the step-shaped groove 102 is pushed against the sharp top 51 when the arrow chain 10 is inserted into the chain hole 2; when the second slider 43 is moved in the direction of the horizontal line B, the sharp top 51 pushes the step-shaped groove 102 to move the arrow chain 10, and after the movement of the arrow chain 10 is completed, the driving block 5 follows the chain driving assembly 4 to move back to its original position, and the sharp top 51 is engaged with another step-shaped groove 421 again. With the repeated operations, the arrow chain 10 can be driven to move in the chain hole 2, to achieve the effect of quickly shooting a large amount of arrow bodies 20, as shown in FIG. 4, FIG. 5 and FIG. 10 to FIG. 12.

For the movement of the arrow chain 10, the configuration of the driving block 5 is the most important design, the arrow chain 10 is in a strip structure which is formed by pivotally connecting multiple chain blocks 103, the connection between the driving block 5 and the chain block 103 after the driving block 5 is released from the chain block 103 is very important; therefore, the second slider 43 has an insertion block 433 protruded on a side thereof corresponding to the driving block 5, the insertion block 433 has a first curved groove 434 recessed on a top thereof, the driving block 5 has a long sliding hole 52 formed corresponding to the insertion block 433, the insertion block 433 is inserted into the long sliding hole 52, an elastic member 6 is disposed between a hole wall of the long sliding hole 52 and the first curved groove 434, and two ends of the elastic member 6 are elastically abutted with the hole wall of the long sliding hole 52 and a sidewall of the first curved groove 434. After the driving block 5 drives the chain block 103 to move, the driving block 5 is moved back to its original position, and during the process of moving back to the original position, the driving block is abutted against an outer surface of next chain block 103, the driving block 5 is pushed to move downwardly by the chain block 103, the elastic member 6 is compressed until the sharp top 51 of the driving block 5 corresponds in position to the step-shaped groove 102 of the chain block 103, the driving block 5 is then released to move upwardly by an elastic force of the elastic member 6, and the sharp top 51 of the driving block 5 is engaged with the step-shaped groove 102. In this way, the operations of moving the arrow chain 10, and positioning the arrow chain 10 after movement can be completed, as shown in FIG. 10 to FIG. 14.

Figure 2:
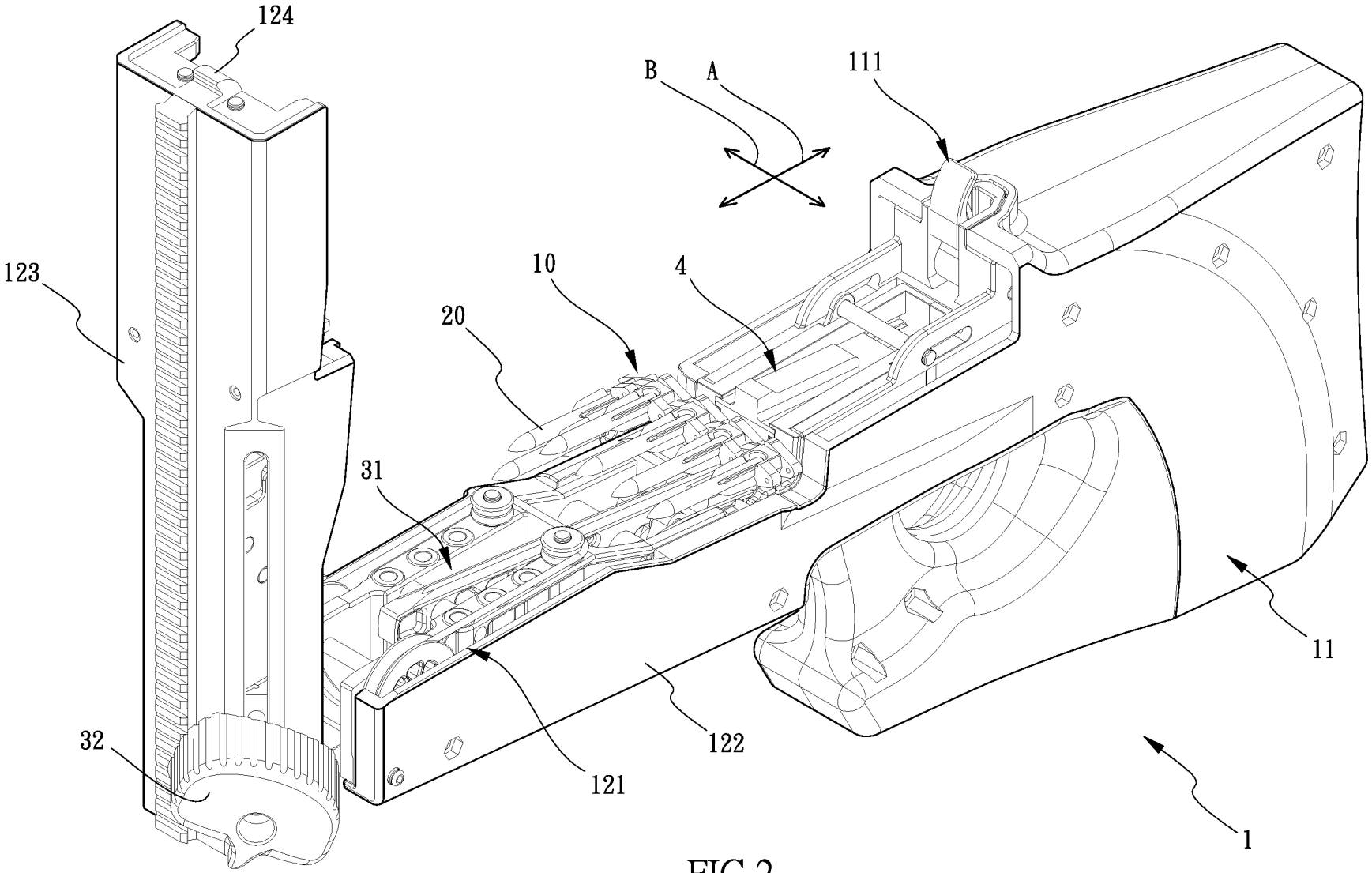
FIG. 2 is a perspective view of a gun cover pivotally swung to open, according to the present invention.
Figure 2A:
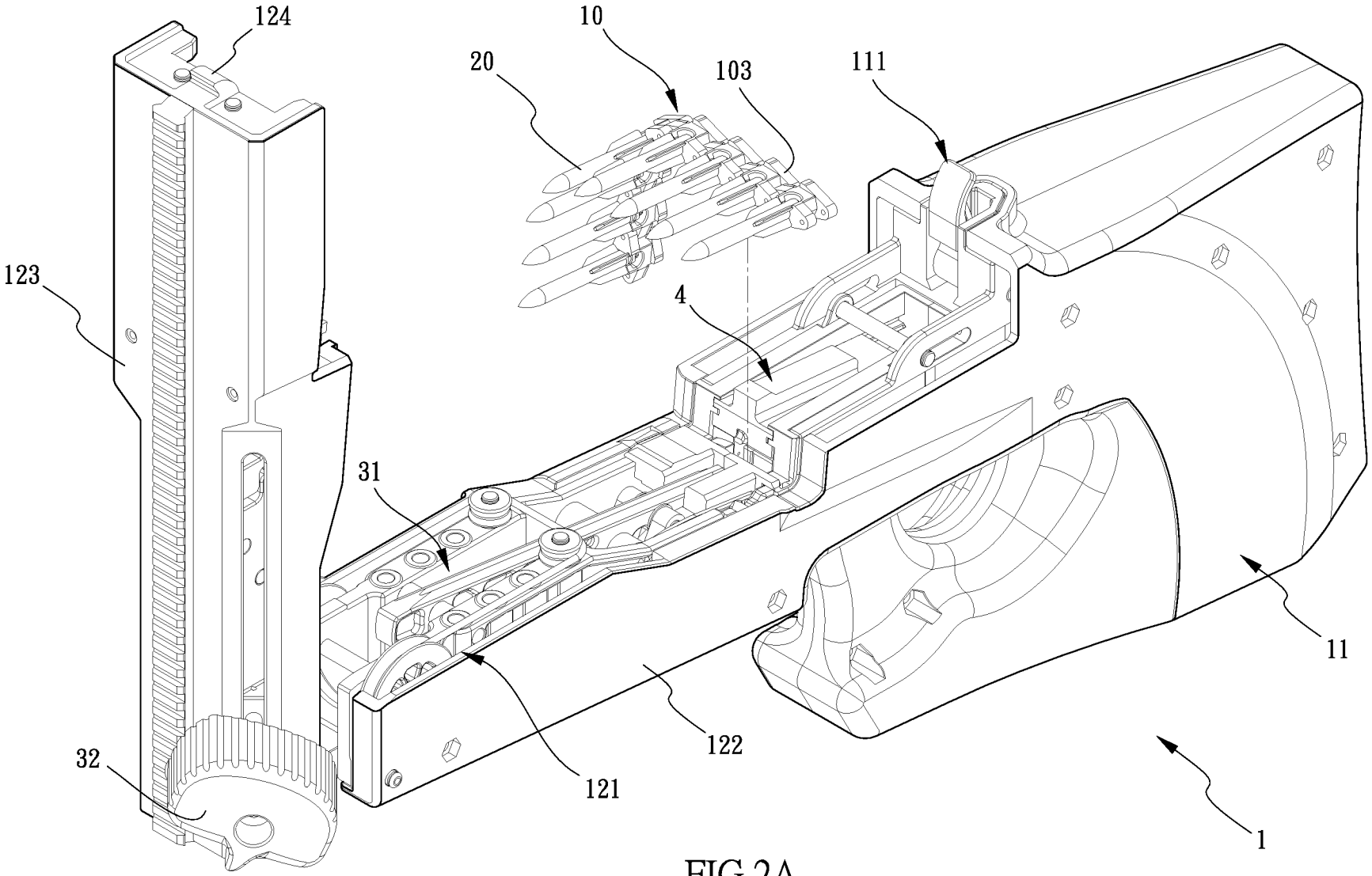
FIG. 2A is a perspective exploded view of an arrow chain and a gun body of the present invention.
Figure 3:
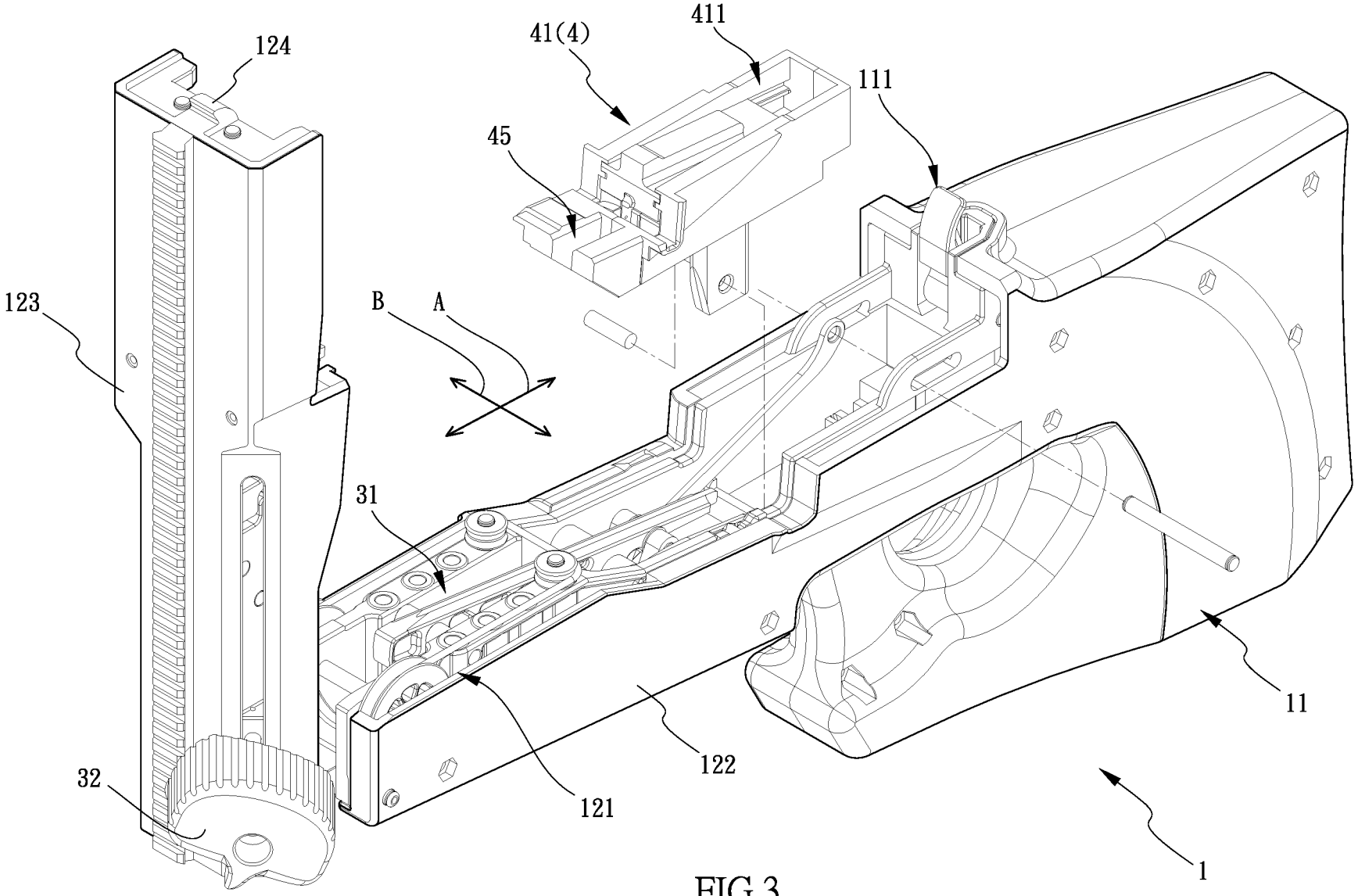
FIG. 3 is an exploded view of a chain driving assembly and a gun body of the present invention.

The design of the gun body 1 of the present invention will be illustrated in the following paragraphs. The front driving part 12 can include an outer gun shell 122 and an gun cover 123, an end of the gun cover 123 is pivoted to the outer gun shell 122, other end of the gun cover 123 is movable close to and away from the rear support part 11; the internal assembly 31 is disposed in the gun chamber 121 of the gun cover 123, the external assembly 32 is disposed outside the gun cover 123 and connected to the internal assembly 31; the rear support part 11 has an engaging assembly 111 disposed on an end thereof connected to the front driving part 12, the gun cover 123 has an engaging block 124 disposed on an end thereof movable close to and away from the rear support part 11. After the gun cover 123 is pivotally swung toward the engaging assembly 111 and covers the gun chamber 121, the engaging block 124 is engaged with the engaging assembly 111, the user can use the engaging or releasing status between the engaging assembly 111 and the engaging block 124 to check the status of the driving assembly 3 and the chain driving assembly 4 in the gun chamber 121 anytime, and even can perform troubleshooting, maintenance, repair, and other operations, to maintain the stability and smooth control of shooting, are shown in FIG. 2.

In order to push the arrow body 20 to release from the arrow chain 10, the base 41 has a driving channel 45 recessed on an end thereof near the internal assembly 31, as shown in FIG. 2 to FIG. 5, a part of the internal assembly 31 is located in the driving channel 45, the external assembly 32 is moved toward the chain driving assembly 4 to push the first slider 42 to move along the direction of the longitudinal line A; after the internal assembly 31 is moved in the first slider 42, the arrow chain 10 is controlled to move, to make the chain block 103 not loading the arrow body 20 move away from the driving channel 45 and make the next chain block 103 loading with the arrow body 20 move to the driving channel 45, as shown in FIG. 10 to FIG. 12. After the movable part of the internal assembly 31 is continuously moved toward the chain driving assembly 4, the part of the internal assembly 31 disposed in the driving channel 45 is upwardly swung to push the arrow body 20 mounted on the arrow chain 10 to release from the arrow chain 10 (not shown in figures); next, a shooting operation can be performed.

The present invention disclosed herein has been described by means of specific embodiments. However, numerous modifications, variations and enhancements can be made thereto by those skilled in the art without departing from the spirit and scope of the disclosure set forth in the claims.

What is claimed is:

1. An arrow shooting device with an arrow chain driving structure, comprising:

a gun body, comprising a gun chamber disposed therein;

a chain hole, cut through a side of the gun body to other side of the gun body, wherein an arrow chain is inserted into a side of the chain hole and exposed out of other side of the chain hole;

a driving assembly, wherein a part of the driving assembly is disposed in the gun chamber and movable in the gun chamber;

a chain driving assembly, disposed in the gun chamber, wherein the part of the driving assembly disposed in the gun chamber is configured to move, push and release the chain driving assembly, the chain driving assembly comprises a first slider and a second slider, the first slider and the second slider are slidably disposed in the gun chamber, a longitudinal line and a horizontal line are defined for a space in the gun chamber, the first slider is movable along a direction of the longitudinal line, the second slider is movable along a direction of the horizontal line, the first slider has at least one oblique groove recessed on a bottom thereof, and the second slider has an oblique guiding block protruded on a top thereof and inserted into the at least one oblique groove;

wherein the second slider has a driving block mounted on an end thereof near the chain hole, and the driving block is engaged with the arrow chain after the arrow chain is inserted into the chain hole;

wherein after the arrow chain is inserted into the side of the chain hole, the arrow chain is engaged with the driving block, the part of the driving assembly pushes the first slider to move along the direction of the longitudinal line, the second slider is driven to move along a direction of the horizontal line by the first slider through connection between the at least one oblique groove and the oblique guiding block, the moving second slider controls the driving block to push the arrow chain to exposed out of the other side of the chain hole.

2. The arrow shooting device with an arrow chain driving structure according to claim 1, wherein the chain driving assembly further comprises a base, and the base comprises two covers, the two covers are combined to form an accommodation space, the accommodation space has track blocks protruded on two inner sidewalls thereof, respectively, the track blocks are disposed along the direction of the longitudinal line, the first slider has track grooves recessed on the two sides thereof and configured to slidably connect to the track blocks, respectively, each of the track blocks is inserted into a corresponding one of the track grooves, and the first slider is moved through the track grooves along an arrangement direction of the track blocks.

3. The arrow shooting device with an arrow chain driving structure according to claim 2, wherein the base has a chain support groove cut through a side of an end thereof near the chain hole, and a driving hole cut through a bottom of the chain support groove, the driving block is disposed in the driving hole and movable along the direction of the horizontal line, and an end of the driving block that is engaged with the arrow chain is protruded out of the driving hole.

4. The arrow shooting device with an arrow chain driving structure according to claim 2, wherein the accommodation space has at least one protrusion plate extended from a bottom thereof to an opening thereof, an arrangement direction of the at least one protrusion plate is in the direction of the horizontal line, and the second slider has an insertion slot formed on a bottom thereof, the at least one protrusion plate is inserted in the insertion slot, and the second slider is movable in an arrangement direction of the at least one protrusion plate.

5. The arrow shooting device with an arrow chain driving structure according to claim 1, wherein the first slider has a stopper block protruded on an end thereof facing the arrow chain, the stopper block is inserted into one of fastening grooves of the arrow chain after the driving block is engaged with the arrow chain.

6. The arrow shooting device with an arrow chain driving structure according to claim 1, wherein the driving block further comprises a sharp top, and the arrow chain has step-shaped grooves formed thereon, the arrow chain is inserted into the chain hole and the sharp top is pushed against one of the step-shaped grooves, wherein when the second slider is moved along the direction of the horizontal line, the sharp top is slid to push the arrow chain to move, wherein when the second slider drives the driving block back to an original position, the sharp top is engaged with another step-shaped groove again.

7. The arrow shooting device with an arrow chain driving structure according to claim 1, wherein the second slider has an insertion block protruded on a side thereof corresponding to the driving block, and the insertion block has a first curved groove recessed on a top thereof, the driving block has a long sliding hole formed correspondingly to the insertion block, the insertion block is inserted into the long sliding hole, an elastic member is disposed between a hole wall of the long sliding hole and the first curved groove, and two ends of the elastic member are elastically abutted with the hole wall of the long sliding hole and a sidewall of the first curved groove.

8. The arrow shooting device with an arrow chain driving structure according to claim 1, wherein the driving assembly comprises an internal assembly and an external assembly, the base has a driving channel recessed on an end thereof close to the internal assembly, a part of the internal assembly is located in the driving channel, the external assembly is moved toward the chain driving assembly and push the first slider to move along the direction of the longitudinal line, wherein after the first slider is moved, the part of the internal assembly that is disposed in the driving channel is upwardly swung to push the arrow chain.

9. The arrow shooting device with an arrow chain driving structure according to claim 8, wherein the gun body further comprises a front driving part and a rear support part, the rear support part is connected to an end of the front driving part, and the front driving part comprises an outer gun shell and a gun cover, an end of the gun cover is pivoted to the outer gun shell, the other end of the gun cover is movable close to and away from the rear support part, the internal assembly is disposed in the gun chamber of the gun cover, and the external assembly is disposed outside the gun cover and connected to the internal assembly.

10. The arrow shooting device with an arrow chain driving structure according to claim 9, wherein the rear support part has an engaging assembly disposed on an end thereof connected to the front driving part, and the gun cover has an engaging block disposed on an end thereof movable close to and away from the rear support part, wherein after the gun cover is pivotally swung toward and near the engaging assembly and covers the gun chamber, the engaging block is engaged with the engaging assembly.

* * * * *